US007980265B2

(12) United States Patent
Holmes et al.

(10) Patent No.: US 7,980,265 B2
(45) Date of Patent: Jul. 19, 2011

(54) VALVE RESPONSIVE TO FLUID PROPERTIES

(75) Inventors: Kevin C. Holmes, Houston, TX (US); Sean L. Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 129 days.

(21) Appl. No.: 11/951,550

(22) Filed: Dec. 6, 2007

(65) Prior Publication Data

US 2009/0145609 A1 Jun. 11, 2009

(51) Int. Cl.
*F16K 17/04* (2006.01)
*G05D 7/01* (2006.01)

(52) U.S. Cl. ..... 137/467.5; 137/455; 138/43

(58) Field of Classification Search ..... 137/455, 137/467.5, 513.3, 547, 172; 138/41, 43, 138/46; 210/131
See application file for complete search history.

(56) References Cited

U.S. PATENT DOCUMENTS

| | | | | | |
|---|---|---|---|---|---|
| 2,341,394 | A | * | 2/1944 | Sloan | 251/120 |
| 2,402,729 | A | * | 6/1946 | Buchanan | 138/43 |
| 2,459,318 | A | * | 1/1949 | Hallinan | 210/131 |
| 2,853,159 | A | * | 9/1958 | Kuhn, Jr. | 137/513.3 |
| 3,168,111 | A | | 2/1965 | Strauss | |
| 3,292,897 | A | * | 12/1966 | McClelland | 251/175 |
| 3,338,548 | A | | 8/1967 | Mott | |
| 3,514,074 | A | * | 5/1970 | Self | 251/127 |
| 3,802,537 | A | * | 4/1974 | White | 181/226 |
| 4,185,664 | A | * | 1/1980 | Zabsky et al. | 138/40 |
| 4,375,821 | A | * | 3/1983 | Nanao | 137/239 |
| 4,409,999 | A | | 10/1983 | Pedziwiatr | |
| 5,261,453 | A | * | 11/1993 | Hekkert et al. | 137/625.38 |
| 5,842,522 | A | * | 12/1998 | Echols et al. | 166/378 |
| 5,853,592 | A | | 12/1998 | Bellos et al. | |
| 6,102,138 | A | | 8/2000 | Fincher | |
| 2002/0102163 | A1 | * | 8/2002 | Dudley | 417/53 |

FOREIGN PATENT DOCUMENTS

WO 2006029961 3/2006

OTHER PUBLICATIONS

Islas-Juarez, R., et al., "Experimental Study of Effective Diffusion in Porous Media", SPE 92196, Nov. 2004, 1-7.
Jackson, M.D., et al. Development and Application of New Downhole Technology to Detect Water Encroachment Toward Intelligent Wells, SPE 97063, Oct. 2005, 1-12 .
Yamali, Nampetch, "Optimum control of Unwanted Water production in Stratified Gas Reservoirs", SPE 106640, Mar. 2007.

* cited by examiner

*Primary Examiner* — John Rivell
(74) *Attorney, Agent, or Firm* — Steve Rosenblatt

(57) ABSTRACT

A valve for downhole use has the ability to throttle between fully open and closed and is fully variable in positions in between. The valve is preferably responsive to flowing fluid viscosity and uses a three dimensional flow through restrictor in combination with a relatively movable cover. At a given flow, a higher viscosity fluid will create a greater relative movement and make it possible for flowing fluid to bypass more of the flow through member. In a particular application involving production from a zone, an array of such valves can allow more production where the viscosity is higher and less production where the viscosity drops due to, for example, water production.

17 Claims, 3 Drawing Sheets

VALVE RESPONSIVE TO FLUID PROPERTIES

FIELD OF THE INVENTION

The field of the invention is separation devices for downhole use and more particularly valves responsive to flowing fluid properties.

BACKGROUND OF THE INVENTION

Valves called chokes are commonly used in oil and gas service to throttle between pressure levels between a fully open and fully closed position. One way they operate is by having a movable sleeve in a stationary housing. The sleeve has a series of longitudinally spaced holes on a common circumference and is manipulated axially for alignment of different sized holes with the fixed port in the outer housing. While this arrangement allows for some setting variability it still leaves gaps in the control because of the step change in sizes between adjacent holes that are longitudinally spaced. Beyond that there are considerations of erosion from high velocity flows, particularly in gas service where solids can be entrained.

One way the present invention addresses this design issue it to move away from the prior design of overlapping openings by using a porous media with a quantifiable resistance per unit length to act as a resistance to flow. Access through the medium is increased or decreased between end positions where one defines the substantially no flow condition and another provides substantially full access over the length of the medium to define the fully open position.

In another aspect, the valve features an ability to respond to a property of the flowing liquid to vary its position responsive, for example, to flowing liquid viscosity. In a screen application, for example, multiple such valves can be in position. When the desired hydrocarbon that has a much higher viscosity than water is flowing, the movable member can leave more of the flow through valve member exposed to reduce resistance to flow. This encourages portions of a zone that are making pure hydrocarbons to continue to do so over other locations where the onset of water production has reduced viscosity. The reduced viscosity allows a closure device to cover more of the flow through the member so as to reduce or cut off flow from areas where water is being produced. This can be accomplished without even having to measure viscosity by making the mechanical components responsive in predetermined ways to an expected range of viscosities. Totally manual as well as totally automatic operations are also contemplated.

These and other aspects of the present invention will become more apparent to those skilled in the art from a review of the description of the preferred embodiment and associated drawings while recognizing that the full scope of the invention is given by the claims.

SUMMARY OF THE INVENTION

A valve for downhole use has the ability to throttle between fully open and closed and is fully variable in positions in between. The valve is preferably responsive to flowing fluid viscosity and uses a three dimensional flow through restrictor in combination with a relatively movable cover. At a given flow, a higher viscosity fluid will create a greater relative movement and make it possible for flowing fluid to bypass more of the flow through member. In a particular application involving production from a zone, an array of such valves can allow more production where the viscosity is higher and less production where the viscosity drops due to, for example, water production.

DETAILED DESCRIPTION OF THE PREFERRED EMBODIMENT

Figure 1:
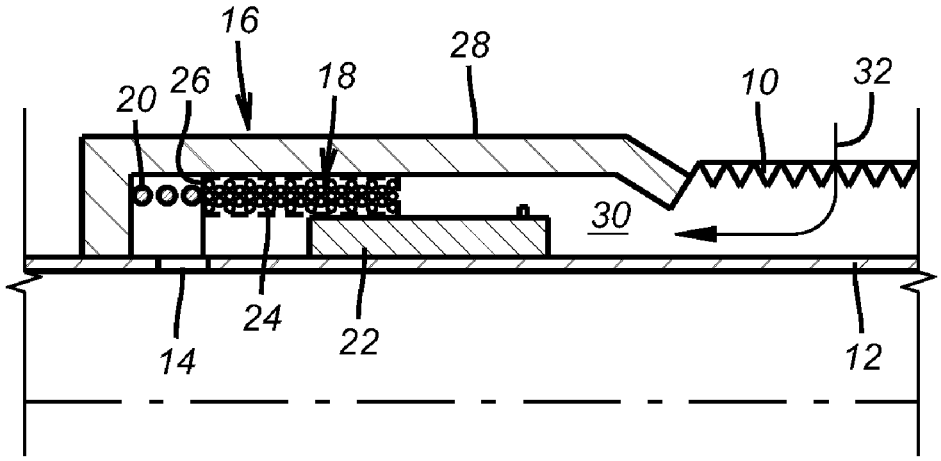
FIG. 1 is a section view of a valve featuring a flow through media partially uncovered due to fluid flow of a low viscosity displacing a sleeve.

In the preferred embodiments the valve assemblies are arrayed in conjunction with an assembly of screens 10 that can span for thousands of feet depending on the configuration of the producing interval. The structural support for the screen assembly 10 is commonly known as a base pipe 12 which runs the length of the screen assembly 10. The base pipe over its length has openings 14. The openings 14 are generally disposed in arrays of multiple openings on a given spacing pattern. While some inflow balancing can be done by varying the cross-sectional area of the arrays along a length of screen 10, another technique is to associate a valve 16 with a given array 14. In the present invention the valve 16 associated with an array 14 is responsive to a fluid property for the fluid flowing through it. In one embodiment the fluid property is viscosity. When a high viscosity desirable hydrocarbon is being produced, the flow in combination with that higher viscosity produced a high enough force on the element 18 to displace it against spring 20 and to offset the element 18 from stationary sleeve 22. Thus in the position of FIG. 1 the element 18 which preferably is made of a pack of beads of a known diameter yielding a network of passages though it of a known size configuration, winds up being short circuited as more flow can exit laterally through side 24 without having to flow to the end 26. Thus the flow paths to end 26 have an axis that intersects with flow paths through side 24, which, in the preferred embodiment, happens to be a cylindrical surface. To complete the structure, an outer tube 28 is used to create an annular space 30 between the screen 10 and the openings 14. In order for flow represented by arrow 32 to reach the openings 14 it has to flow through the porous material element 18 which is movably mounted over sleeve 22 which is fixed. The flow passing through element 18 creates a pressure drop and a net force that compressed the spring 20. As the spring 20 is compressed and the element 18 shifts to the left, more of the side 24 of element 18 comes out of alignment with sleeve 22. The more viscous the material is that represents flow 32 the greater the force exerted on spring 20, the more element 18 shifts left and as a result the less resistance to flow is offered to the viscous fluid as more of the flow entering the element 18 can make a fast lateral exit out the side surface 24 that is no longer in alignment with sleeve 22.

Figure 2:
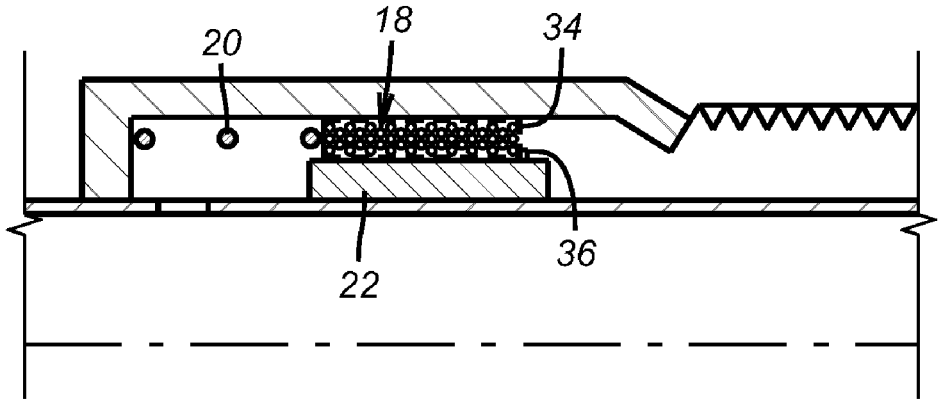
FIG. 2 is the view of FIG. 1 with a low viscosity fluid present that allows the flow through media sleeve to be spring biased to cover more of the flow through media.

On the other hand, if the viscosity drops, indicating the appearance of water, for example, or some other unwanted fluid, the net pressure exerted for a given flow rate against the element 18 will drop as that given flow rate can move through the porous element with less resistance. When that happens, the spring 20 can shift the element 18 to the right to an extreme position where the element 18 comes into alignment with sleeve 22, as shown in FIG. 2. The end 34 can be made impervious and depending on the strength of spring 20 the valve 16 in the FIG. 2 position can be fully closed to fluids. A seat 36 that also acts as a travel stop for the element 18 can be provided in the form of an inner and outer seal rings such that if combined with an impervious end 34 and a strong enough spring 20 can actually close the valve 16 if the viscosity drops low enough due to production of an unwanted fluid such as water.

Figure 3:
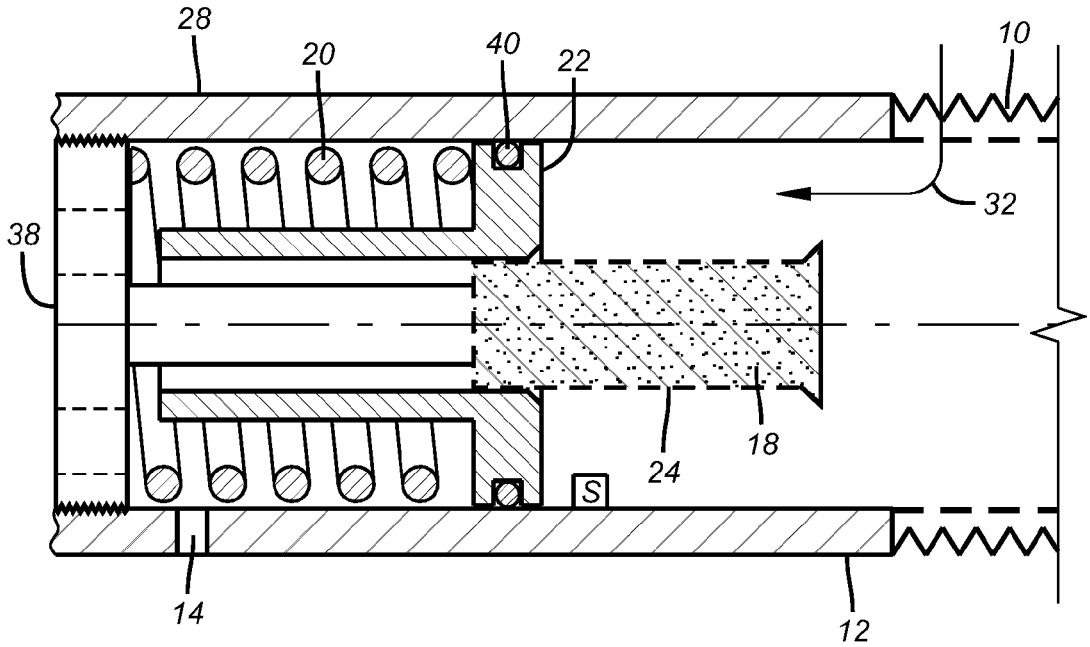
FIG. 3 is an alternative embodiment to FIG. 1 showing the inverse of the FIG. 1 design where the blank sleeve is movable rather than the flow through media.
Figure 4:
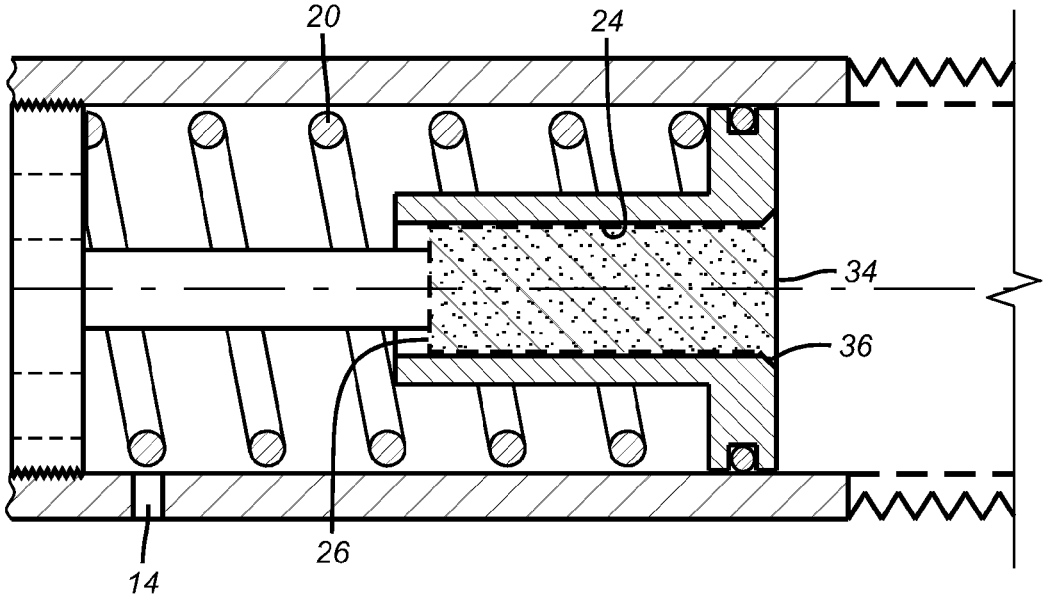
FIG. 4 is the view of FIG. 3 where a low viscosity fluid is flowing that allows the sleeve to advance over the flow through media to retard flow.

FIGS. 3 and 4 are simply a reverse of the design of FIGS. 1 and 2. The element 18 is now fixed to a retainer 38. The sleeve 22 is movably mounted with a peripheral seal ring 40. When the viscosity of the flowing fluid 32 is high the force against sleeve 22 will overcome the spring 20 and expose more of the side surface 24 of the element 18 which will mean a reduction of resistance to flow and enhanced flow of the desirable hydrocarbon through screen 10. On the other hand, if the viscosity drops, for a given flow rate the force on sleeve 22 will decrease to allow spring 20 to shift element 18 to the FIG. 4 position such that the side surface 24 is substantially within the sleeve 22 and resistance to flow goes higher because all the flow has to go clean through the length of the element 18 to the only exit at end 26. Optionally, end 34 can be impervious and come up against a seal ring 36. Then, if the spring 20 is strong enough, the valve in the FIG. 4 position can exclude fluid.

Figure 5:
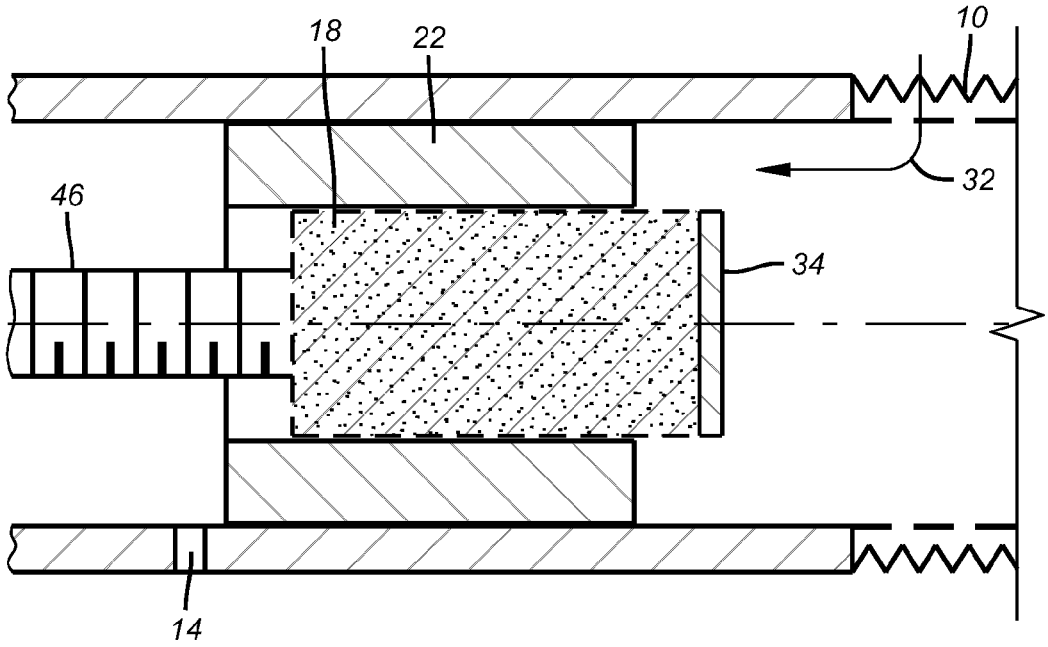
FIG. 5 is a manual design that allows moving the flow though media with respect to a surrounding stationary sleeve.
Figure 6:
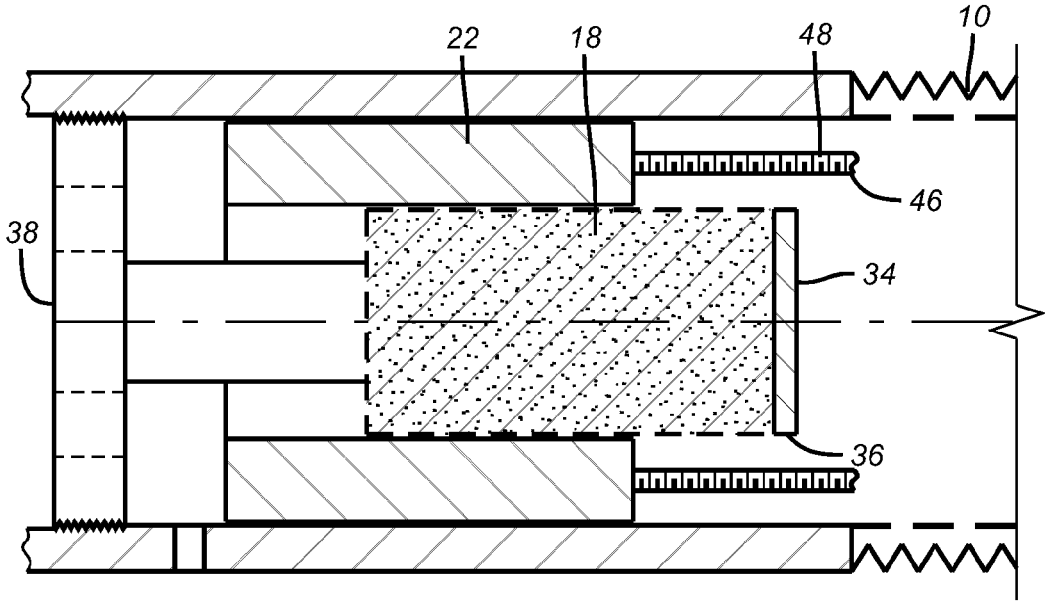
FIG. 6 is the reverse of FIG. 5 where the sleeve is movable with respect to a stationary flow through media.

FIGS. 5 and 6 illustrate totally manual operation. In FIG. 5, the element 18 is secured to an operator 46 with sleeve 22 held fixed. The sleeve 18 is movable relative to fixed sleeve 22. In FIG. 6 the element 18 is held fixed by retainer 38 while the sleeve 22 is moved by the adjustment mechanism 46. Optionally an impervious end cap 34 can be used to shut off flow while the resistance to flow is infinitely variable by simply positioning the element 18 either more in alignment with sleeve 22 or less so.

Element 18 is preferably a cylindrical shape of a bead pack or a sintered material or some other porous material. The passages or openings through it need not be uniform. Rather the structure needs to be responsive to a change in fluid property and respond to such a change for a given flow rate with a change in force applied to a closure device. In the preferred embodiment the fluid property that changes that affects the movement of the element 18 or its associated sleeve 22 is viscosity. The actual viscosity need not be locally measured but it can be and in association with a processor connected to an operator that replaces spring 20 can achieve the same result. The illustrated preferred embodiments are just simpler and cheaper and more reliable in that they need not literally measure the fluid property change that affects their performance. Instead, what needs to be known for a given configuration of porous element is its pressure versus flow characteristics for a given viscosity.

On the other hand using a system, schematically illustrated as S, that senses an actual fluid property and can convert that signal using a processor into a proportional movement, the same effect of keeping out undesirable ingredients can be accomplished if there is a fluid property that identifies the undesirable ingredient. For example pH may be used as a measured quantity to affect changes in relative position between the element 18 and the sleeve 22.

While the element 18 has been depicted as a cylinder surrounded by a sleeve 22 the arrangement can be inverted using an impervious cylindrical plug surrounded by a porous annularly shaped member as shown in FIGS. 1 and 2. While a coil spring 20 is illustrated, equivalents such as pressurized chambers, Belleville washer stacks or other devices that store potential energy could be used. Alternatively a control system can use motors of various types such as a stepper motor or a ball screw assembly to create the relative movement responsive to fluid property change.

In another variation, the actual flowing fluid can be analyzed as it passes a sensor to specifically identify ingredients and operate the valve 16 to exclude the unwanted fluids.

The design of a pair of members where there is relative movement and flow though one of the members allows infinite variability in a throttling application such as a choke with a possibility of dramatically reducing or cutting off unwanted flows. Another advantage is better resistance to the erosive effects of high velocities and a cheaper way to rebuild the valve if necessary by simply replacing a porous element.

The above description is illustrative of the preferred embodiment and many modifications may be made by those skilled in the art without departing from the invention whose scope is to be determined from the literal and equivalent scope of the claims below.

We claim:

1. A valve assembly for subterranean use, comprising:

at least one housing having a single flow path therethrough;

at least one porous valve member in said flow path for automatically regulating flow therethrough, said flow passing through said valve member in multi-planar intersecting axes without bypassing said valve member;

relative movement between said valve member and said housing between a first and a second opposed end positions which is affected by flow regulates flow between said end positions of said valve member through at least one of said multi-planar intersecting axes, the amount of said relative movement being automatically responsive to changes in a physical property of said fluid.

2. The assembly of claim 1, wherein:

flow in one of said axes is restricted independently of flow in another axis.

3. The assembly of claim 1 , wherein:

said physical property comprises viscosity.

4. The assembly of claim 1, wherein:

said valve member comprises a longitudinal axis and an elongated exterior surface surrounding said axis: and said axes for said flow comprise flow paths extending substantially along said longitudinal axis and other paths entering said valve member through said exterior surface.

5. The assembly of claim 4, wherein:

said relative movement selectively covers or uncovers said exterior surface.

6. The assembly of claim 5, wherein:

the amount of said relative movement for a predetermined flow rate is determined by a physical property of the flowing fluid.

7. The assembly of claim 1, wherein:

said valve member is movable with respect to said housing.

8. The assembly of claim 1, wherein:

a portion of said housing is movable with respect to a stationary valve member.

9. The assembly of claim 1, wherein:

said valve member is made of a pack of beads or a sintered metal.

10. The assembly of claim 9, wherein:

said valve member is one of a cylindrical and an annular shape.

11. The assembly of claim 1, wherein:

said assembly further comprises a control system to sense a physical property of said flow and create relative movement between said valve member and said housing responsive to said sensed physical property.

12. A valve assembly for subterranean use, comprising:

at least one housing;

at least one porous valve member in said housing for automatically regulating flow therethrough, said flow passing through said valve member in multi-planar intersecting axes;

relative movement between said valve member and said housing which is initiated by flow regulates flow in at least one of said multi-planar intersecting axes, the amount of said relative movement being automatically responsive to changes in a physical property of said fluid;

said valve member comprises a longitudinal axis and an elongated peripheral surface surrounding said axis:

said axes for said flow comprise flow paths extending substantially along said longitudinal axis and other paths entering said valve member through said peripheral surface;

said relative movement selectively covers said peripheral surface;

the amount of said relative movement for a predetermined flow rate is determined by a physical property of the flowing fluid;

said relative movement is resisted by bias force acting in a direction to cover said peripheral surface.

13. The assembly of claim 12, wherein:

said physical property comprises viscosity such that the force exerted by said flow against said bias is increased to expose more of said peripheral surface when the viscosity rises for a predetermined flow rate and decreases to expose less of said peripheral surface for that flow rate when the viscosity decreases.

14. The assembly of claim 13, wherein:

said relative movement occurs without measurement of said viscosity.

15. The assembly of claim 14, wherein:

said valve member increasing resistance to flow therethrough from relative movement induced by flow of water as opposed to a more viscous hydrocarbon.

16. The assembly of claim 15, wherein:

said assembly comprises a plurality of valve members associated with a plurality of housings situated adjacent spaced openings in a base pipe of a screen assembly;

said valves that experience a reduction in viscosity of the flow increasing resistance to flow as compared to other valves where the viscosity of the flow is higher.

17. The assembly of claim 16, wherein:

said valve members having an impervious inlet end surface adjacent said peripheral surface for selectively restricting flow through said valve member when said peripheral surface is covered by said housing.

* * * * *